US006566605B1

(12) United States Patent
Prudhon

(10) Patent No.: US 6,566,605 B1
(45) **Date of Patent: *May 20, 2003**

(54) MULTIPLE PAIR CABLE WITH INDIVIDUALLY SHIELDED PAIRS THAT IS EASY TO CONNECT

(75) Inventor: Daniel Prudhon, Fumay (FR)

(73) Assignee: Nexans, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/197,513

(22) Filed: Nov. 23, 1998

Related U.S. Application Data

(63) Continuation of application No. 08/713,700, filed on Sep. 13, 1996, now Pat. No. 5,952,615.

(30) Foreign Application Priority Data

Sep. 15, 1995 (FR) ..... 95 10844

(51) Int. Cl.[7] ..... H01B 11/06
(52) U.S. Cl. ..... 174/113 C; 174/131 A
(58) Field of Search ..... 174/113 C, 113 R, 174/131 A, 131 R, 36

(56) References Cited

U.S. PATENT DOCUMENTS

| | | | | |
|---|---|---|---|---|
| 8,429 | A | 9/1851 | Vermilya et al. | 428/592 X |
| 483,285 | A | 9/1892 | Guilleaume | 174/27 X |
| 661,109 | A | 11/1900 | Schmitz | 228/117 X |
| 1,780,564 | A | 11/1930 | Oxer | 174/131 R |
| 3,819,443 | A | 6/1974 | Simons et al. | 156/204 |
| 3,911,200 | A | 10/1975 | Simmons et al. | 174/36 |
| 4,038,487 | A | 7/1977 | Apen et al. | 174/36 |
| 5,132,488 | A | 7/1992 | Tessier et al. | 174/113 R X |
| 5,416,155 | A | 5/1995 | Aladenize et al. | 524/495 X |

FOREIGN PATENT DOCUMENTS

| | | | |
|---|---|---|---|
| DE | 39 11 978 A1 | 2/1990 | |
| FR | 684813 | 7/1930 | 174/131 A |

*Primary Examiner*—Chau N. Nguyen
(74) *Attorney, Agent, or Firm*—Sughrue Mion, PLLC

(57) ABSTRACT

A multiple pair cable with individually shielded pairs and that is easy to connect has a circular cross-section and includes a plurality of individually insulated conductor pairs and an electrical shield around each pair. The electrical shields of the various pairs include a central rod with radial fins separating the pairs from each other and partially shielding each pair and a peripheral shield around the rod and all of the pairs between the fins and completing the shielding of each pair.

5 Claims, 3 Drawing Sheets

MULTIPLE PAIR CABLE WITH INDIVIDUALLY SHIELDED PAIRS THAT IS EASY TO CONNECT

This is a continuation of application Ser. No. 08/713,700 filed Sep. 13, 1996 now U.S. Pat. No. 5,952,615, the disclosure of which is incorporated herein by reference.

BACKGROUND OF THE INVENTION

1. Field of the Invention

The present invention concerns cables comprising multiple pairs of individually insulated electrical conductors for transmitting high-frequency signals with low crosstalk between the pairs, for example computer cables. It concerns in particular a multiple pair cable with individually shielded pairs that is easy to connect.

2. Description of the Prior Art

Crosstalk is a key parameter in this type of cable and crosstalk can be considerably reduced by individually shielding the pairs of the cable.

The most common solution to the problem of shielding each pair is to wrap a metal or metallized tape helically around each pair before assembling the individually shielded pairs into a common protective sheath. Tape wrapping each pair is a lengthy operation, and is necessarily carried out as an additional stage on each pair already made up in order to obtain satisfactory high-frequency transmission characteristics. Tape wrapping during the construction of the pairs is not suitable since the pitch of the tape wrap is then the same as that of the conductors in each pair concerned and the regularity of the pitch required for compatibility with transmission at high bit rates cannot be guaranteed.

To connect the cable the individual shields of the pairs must be removed to obtain access to the conductors, which makes connection on site a lengthy and difficult operation.

Document GB-A-1 546 609 describes a computer cable with a plurality of individually shielded pairs. This cable is a flat cable with the pairs side-by-side. The pairs are shielded by two tapes which cover all of the pairs extending between them and are joined together on each side of each pair. Each shielding tape comprises a strip of metal, for example aluminum, coated on at least one side with a thermoplastics material and preferably on the other side with a synthetic polyester resin. The sides covered with the thermoplastics material are placed face-to-face in order to bond them by application of heat and thereby connect the two shielding tapes.

A tearing line is provided along each area of joining of the two tapes between the pairs, either on both tapes or preferably on one tape only. Such tearing lines facilitate access to the conductors of the pairs for connecting the cable.

A drawback of this cable is the result of its flat structure, which makes the cable relatively wide and flexible in one direction only so that it tends to twist during installation. This is a problem in particular in the case of a flat cable comprising four pairs, like the type of cable most frequently used in computer networks, as the cable is then very wide. It is necessary to untwist it during installation and this makes it very vulnerable to traction.

Document U.S. Pat. No. 3,819,443 describes a shielding member comprising laminated strips of metal and plastics material that are cut, bent and assembled together to define radial branches on said member. It also describes a cable including a set of conductors arranged in pairs, said shielding member and an insulative outer sheath around the set of conductors. In this cable the shielding member with the radial branches compartmentalizes the interior of the cable. The various pairs of the cable are therefore separated from each other, but each is only partially shielded, which is not so effective as shielding around each pair and is not always satisfactory.

An object of the present invention is to provide a multiple pair cable with individually shielded pairs that is easy to connect and has a circular cross-section that does not have the drawbacks of the previously described flat cable with individually shielded pairs.

SUMMARY OF THE INVENTION

The invention consists in a multiple pair cable with individually shielded pairs and that is easy to connect, having a circular cross-section and including a plurality of individually insulated conductor pairs and an electrical shield around each pair, wherein the electrical shields of the various pairs comprise a central rod with radial fins separating the pairs from each other and partially shielding each pair and a peripheral shield around the rod and all of the pairs between the fins and completing the shielding of each pair.

The above cable advantageously has at least one of the following additional features:

- the rod includes at least one metal tape inside the fins and covered with a common insulative covering,
- the rod comprises an insulative material member of constant cross-section with an exterior metallization that is continuous from one fin to the next,
- the rod is made from a semiconductor polymer material and has a constant cross-section,
- the rod is twisted into a spiral.

The features and advantages of the invention will emerge from the following description of the embodiments shown in the appended drawings.

DETAILED DESCRIPTION OF THE PREFERRED EMBODIMENT

Figure 1:
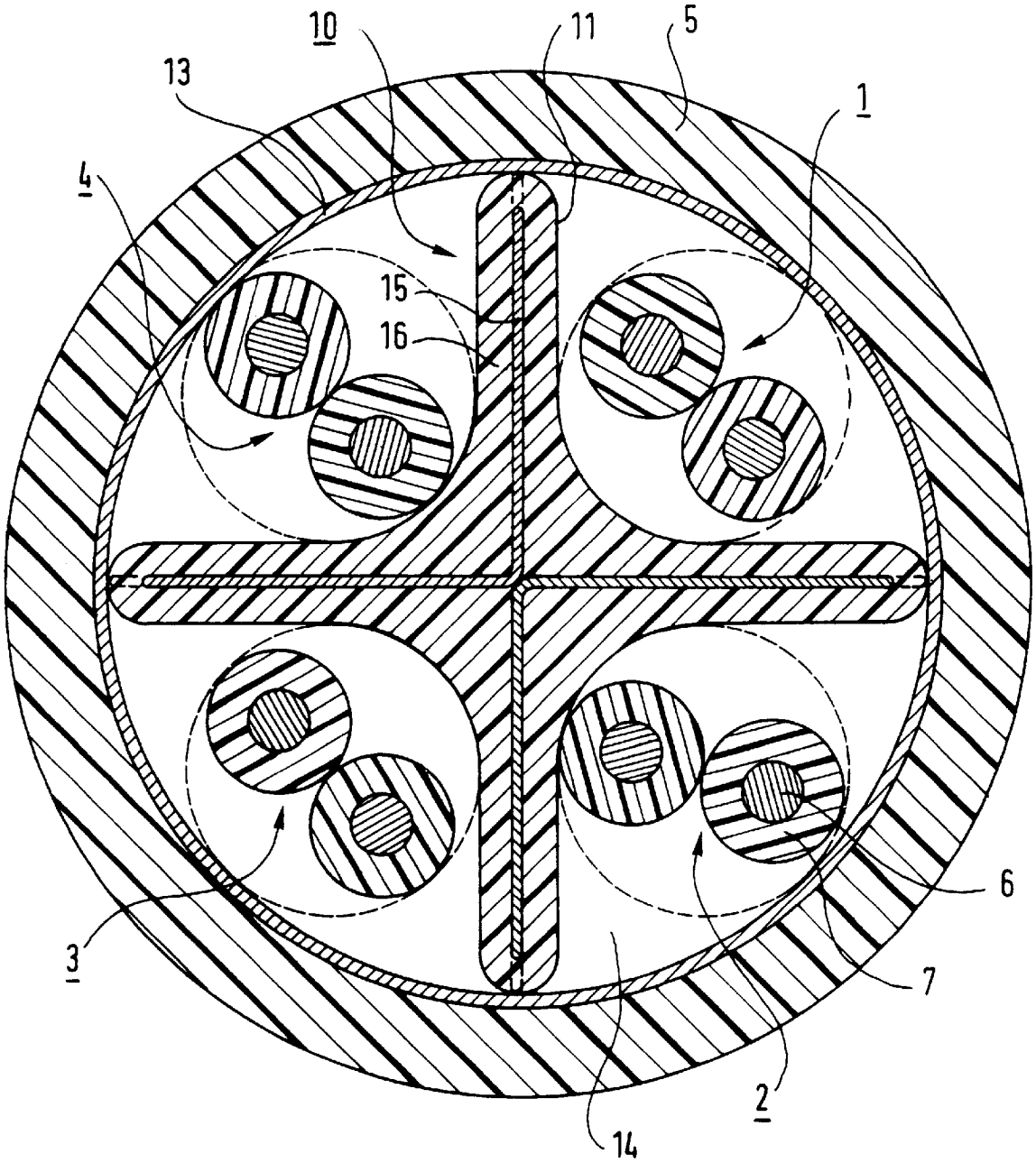
FIG. 1 is a cross-sectional view of a cable of the present invention.
Figure 2:
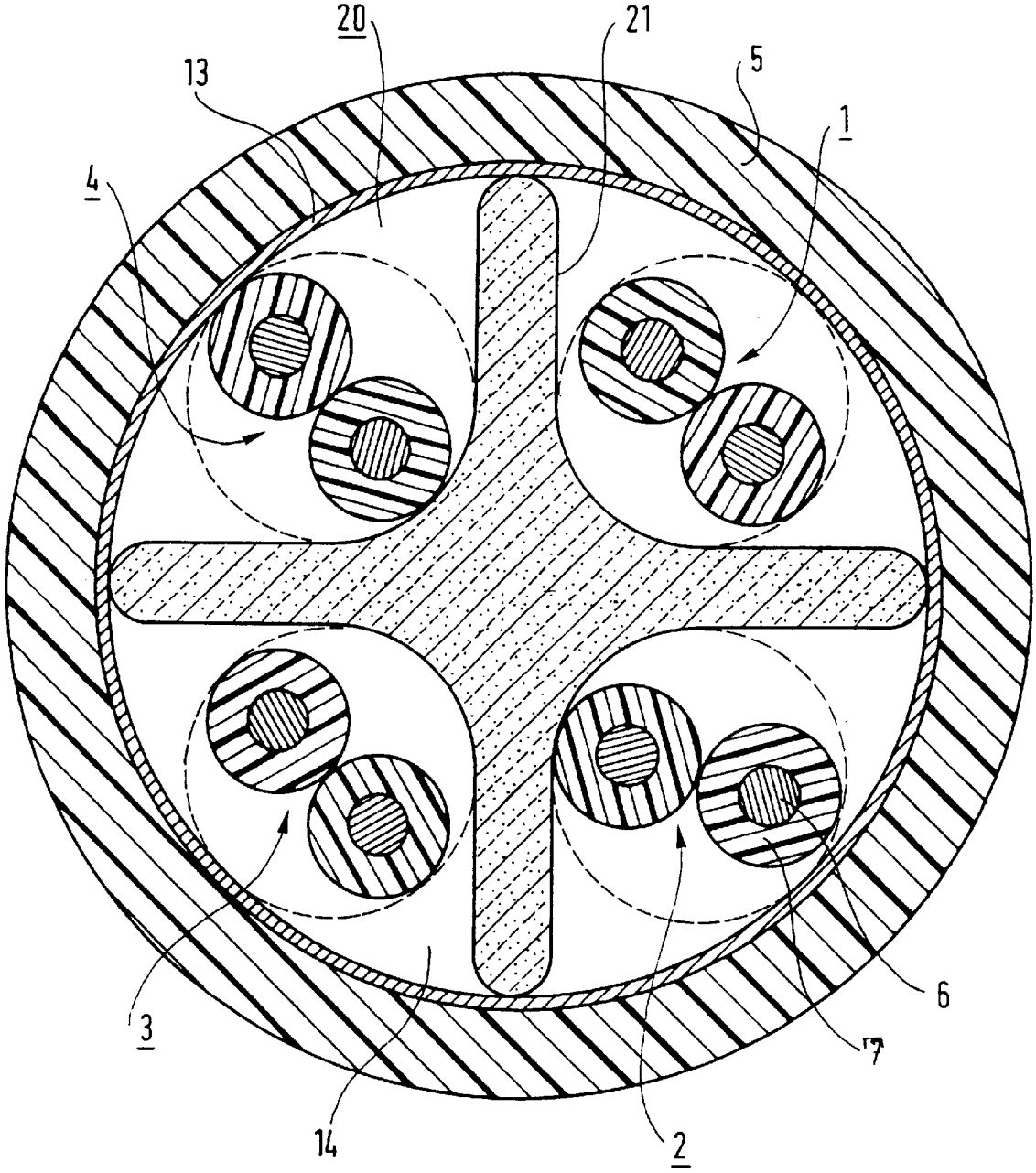
FIG. 2 is a cross-sectional view of a variant of the same cable.

The cable shown in FIGS. 1 and 2 has a circular cross-section. It comprises four pairs 1 through 4 of electrical conductors, the pairs being individually shielded, and a protective outer sheath 5 around the set of shielded pairs.

The conductors of the pairs are identical. Each has a conductive core 6 surrounded by insulation 7. The two electrical conductors of each pair are twisted together. The cable can obviously include a different number of pairs, although the cables most widely used in computer networks have four pairs.

In FIG. 1, the pairs are individually shielded by a rod 10 with radial fins 11 which separate the pairs and partially shield each pair and by a peripheral shield 13 surrounding the rod and the set of pairs in place therein and completing the shielding of each pair.

For this cable with four pairs the rod 10 with fins 11 is cruciform in shape and defines four V-shape compartments 14 each receiving one of the four pairs. It comprises two metal tapes 15 in a cruciform arrangement covered with insulation 16, for example polyethylene. The tapes inside the rod form electrostatic partitions between the compartments 14.

The rod is made by excluding the covering 16 over the cruciform arrangement of the two metal tapes 15. The initially flat tapes are bent longitudinally at right angles along their median axis and are placed together along the bending line to form four branches at 90° to each other immediately before extruding the covering. The edges of the strips can be flush with the surface of the covering at the periphery of the rod, as shown in dashed outline, to achieve continuity between the peripheral shield 13 and the interior tapes.

Figure 3:
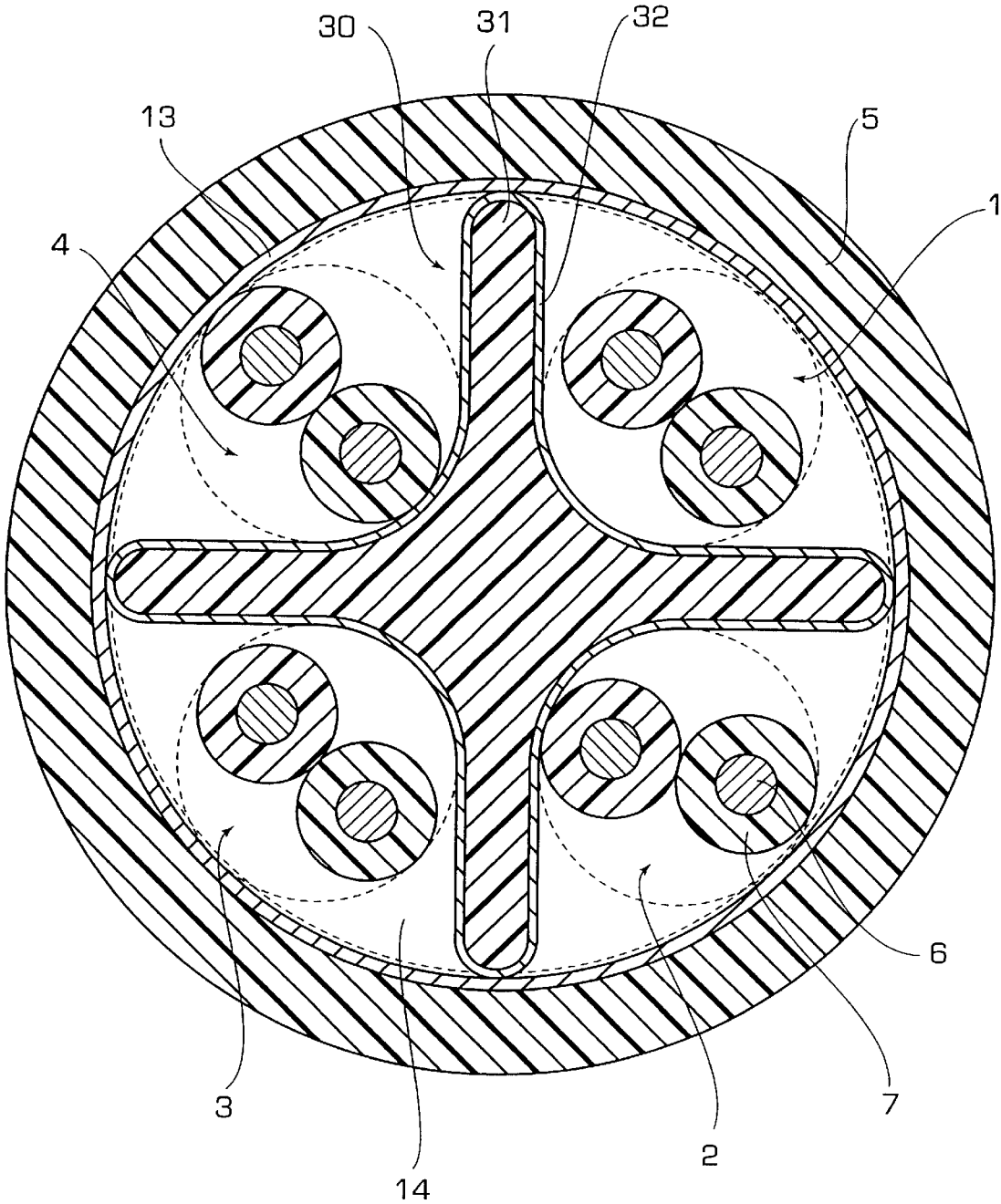
FIG. 3 is a cross-sectional view of another variant of the same cable.

In a different embodiment (FIG. 3, a rod 30 made up of finned insulation material 31. which is extruded and externally the exterior metallization 32, the metallization being continuous from one fin to the next.

The pairs are assembled to the rod 10 as the rod moves past the point of coming together of the pairs. The pairs are deposited in the various compartments and the rod may be twisted into a spiral, for example in a rotating machine, with the pairs in place in the compartments. The twisted rod is represented by the broken lines around the outer periphery of the tips of the fins in FIG. 3 (similar to the way the broken lines around the conductor pairs represent the twisted pairs of conductors).

The shield 13 is a metal or combined plastics and metal tape. It is wrapped helically around the rod and the pairs as the pairs are placed in the compartments. The shield closes each V-shaped compartment. In this way each pair is individually shielded.

The protective sheath 5 is formed immediately after application of the shield 13 and is preferably extruded.

FIG. 2 shows a variant of the cable of the invention in which parts identical to those of the FIG. 1 cable are identified by the same reference numbers and are not described again. Only the differences are described below.

In FIG. 2, the individual pairs are shielded by the shield 13 previously described and a semiconductor polymer material which can be very weakly conductive at low electric fields and have a conductivity that increases with the field. The rod 20 also has radial fins 21. The material of the rod 20 can be of the type described in U.S. Pat. No. 5,416,155, which has a polymer matrix having an electrical conductivity less than $10^{-8}$ S/m but which increases as the electric field increases. The polymer matrix of this material includes a first thermoplastic or thermosetting insulative polymer and a second doped or undoped conjugate polymer having an electrical conductivity less than $10^{-4}$ S/m which increases as the electric field increases, representing between 5% and 70% by weight of said matrix. It may further contain a conductive charge, for example carbon black.

The rod 20 is preferably extruded but may instead be molded, injection molded or rolled. The fins of the rod 20 again constitute shielding partitions between the compartments, the effectiveness of which is proportional to the magnitude of the effect of the pairs on each other in the absence of the shielding thus obtained.

The cable of the invention is faster to manufacture and easier to manufacture on an industrial scale than circular cross-section cables with a shielding tape wrapped around each pair. Its impedance is very regular, which makes it compatible with transmission at high bit rates. It is also easy and quick to fit with a connector on site since to obtain access to the conductors of the pair all that is required is to remove the sheath from an appropriate length of the cable, to remove the peripheral shield over this same length and then to cut through the rod; this represents an important saving in time. The risks of damaging the conductors or disrupting the arrangement of the pairs when fitting the connector are also largely avoided.

What is claimed is:

1. A multiple pair cable with individually shielded pairs, having a circular cross-section, comprising:

a plurality of pairs of insulated conductors; and electrical shields surrounding each of said pairs of insulated conductors, wherein said electrical shields include a central rod with radial fins separating said pairs of insulated conductors from each other and partially shielding said pairs of insulated conductors, and a peripheral shield surrounding said rod and said pairs of insulated conductors being separated from each other for completing the shielding of each of said pairs of insulated conductors.

2. The cable claimed in claim 1 wherein said rod includes at least one metal tape inside said fins and covered with a common insulative covering.

3. The cable claimed in claim 1 wherein said rod is made from a semiconductor polymer material and has a constant cross-section.

4. The cable claimed in claim 1 wherein said rod has four fins defining between them four V-shaped compartments for a cable with four pairs.

5. The cable claimed in claim 1 wherein said rod is twisted into a spiral.

* * * * *